US010188200B1

(12) United States Patent
Hetzner

(10) Patent No.: US 10,188,200 B1
(45) Date of Patent: Jan. 29, 2019

(54) MODULAR DESIGNED POOL CLEANING TOOL

(76) Inventor: Jess L. Hetzner, Temecula, CA (US)

( * ) Notice: Subject to any disclaimer, the term of this patent is extended or adjusted under 35 U.S.C. 154(b) by 194 days.

(21) Appl. No.: 12/955,766

(22) Filed: Nov. 29, 2010

Related U.S. Application Data

(63) Continuation-in-part of application No. 11/618,965, filed on Jan. 2, 2007, now Pat. No. 7,891,132.

(51) Int. Cl.
*A46B 9/10* (2006.01)
*E04H 4/16* (2006.01)
*A46B 5/00* (2006.01)

(52) U.S. Cl.
CPC ..... *A46B 5/0095* (2013.01); *A46B 9/10* (2013.01); *E04H 4/16* (2013.01)

(58) Field of Classification Search
CPC ..... A46B 5/0095; A46B 9/10; E04H 4/16
USPC ..... 15/143.1, 144.1, 146, 159.1, 160, 202
See application file for complete search history.

(56) References Cited

U.S. PATENT DOCUMENTS 1,983,923 A * 12/1934 Stevens et al. ..... 403/198
2,472,572 A 6/1949 Dailey
2,561,025 A * 7/1951 Le Febvre ..... A46B 5/00 15/144.1
3,004,362 A 10/1961 Day
3,085,267 A * 4/1963 Jacuzzi ..... 15/1.7
3,134,129 A * 5/1964 Allen ..... 401/138
3,206,783 A * 9/1965 Schwartz ..... A47L 13/41 15/105
3,377,641 A * 4/1968 McGregor ..... 15/105
4,247,216 A * 1/1981 Pansini ..... 403/109.3
4,407,038 A * 10/1983 Haase ..... B03C 1/30 15/105
4,446,646 A 5/1984 Van't Veld
4,466,152 A * 8/1984 Moss et al. ..... 15/229.2
4,606,091 A * 8/1986 Sartori ..... 15/195
4,619,065 A 10/1986 Jones
4,637,087 A * 1/1987 Feinberg ..... 15/1.7
4,870,773 A 10/1989 Schmucker et al.
5,161,278 A * 11/1992 Tomm ..... 15/159.1
5,473,786 A 12/1995 Resh
5,487,397 A * 1/1996 Bean ..... 134/6
5,551,115 A * 9/1996 Newville ..... 15/172
5,568,668 A * 10/1996 Margolin ..... 15/176.3
5,890,254 A * 4/1999 Courtney et al. ..... 15/145
(Continued)

OTHER PUBLICATIONS

Purity Pool Leaf Rakes Catalog, 2 pg.

*Primary Examiner* — David J Parsley
(74) *Attorney, Agent, or Firm* — Knobbe, Martens, Olson & Bear LLP

(57) ABSTRACT

A modularly designed cleaning tool such as a pool is provided with a reinforced neck area to substantially reduce breakage during use. The cleaning tool includes a brush head, a stem assembly, and a reinforcement fitting positioned at the joint area between the brush head and the stem assembly. The cleaning tool is adapted to mate with an elongated tubular pole or handle in a manner such that the pole or handle extends into the annular space defined by the reinforcement fitting and the stem assembly. The cleaning tool also includes a brush having an elongated frame and removable corner bristles extending therefrom. In some implementations, magnetic attachments are disposed on the brush frame and are adapted to pick up magnetic debris along a surface during cleaning.

20 Claims, 9 Drawing Sheets

(56) References Cited

U.S. PATENT DOCUMENTS

| | | | | |
|---|---|---|---|---|
| 6,134,739 | A * | 10/2000 | Gonzalez | 15/175 |
| 6,199,241 | B1 * | 3/2001 | Anumah | 15/160 |
| 6,302,277 | B1 | 10/2001 | Resh | |
| 6,368,502 | B1 | 4/2002 | Resh | |
| 6,408,560 | B1 | 6/2002 | Bloom | |
| 6,594,850 | B2 * | 7/2003 | Libman et al. | 15/145 |
| 6,872,026 | B2 * | 3/2005 | Petner | 403/379.3 |
| 7,124,533 | B2 | 10/2006 | Kleckner | |
| 7,269,921 | B2 | 9/2007 | Lee | |
| 7,395,629 | B1 | 7/2008 | Thomas | |
| 7,721,380 | B2 * | 5/2010 | Libman et al. | 15/175 |
| 7,730,571 | B2 * | 6/2010 | Libman | 15/145 |
| 2004/0255427 | A1 * | 12/2004 | Gavney, Jr. | 15/401 |
| 2006/0218738 | A1 * | 10/2006 | Brugora | 15/159.1 |

* cited by examiner

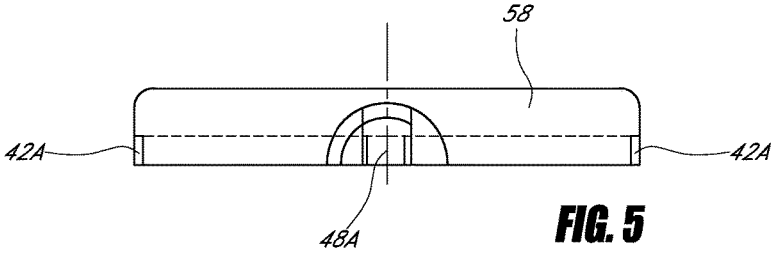
FIG. 5
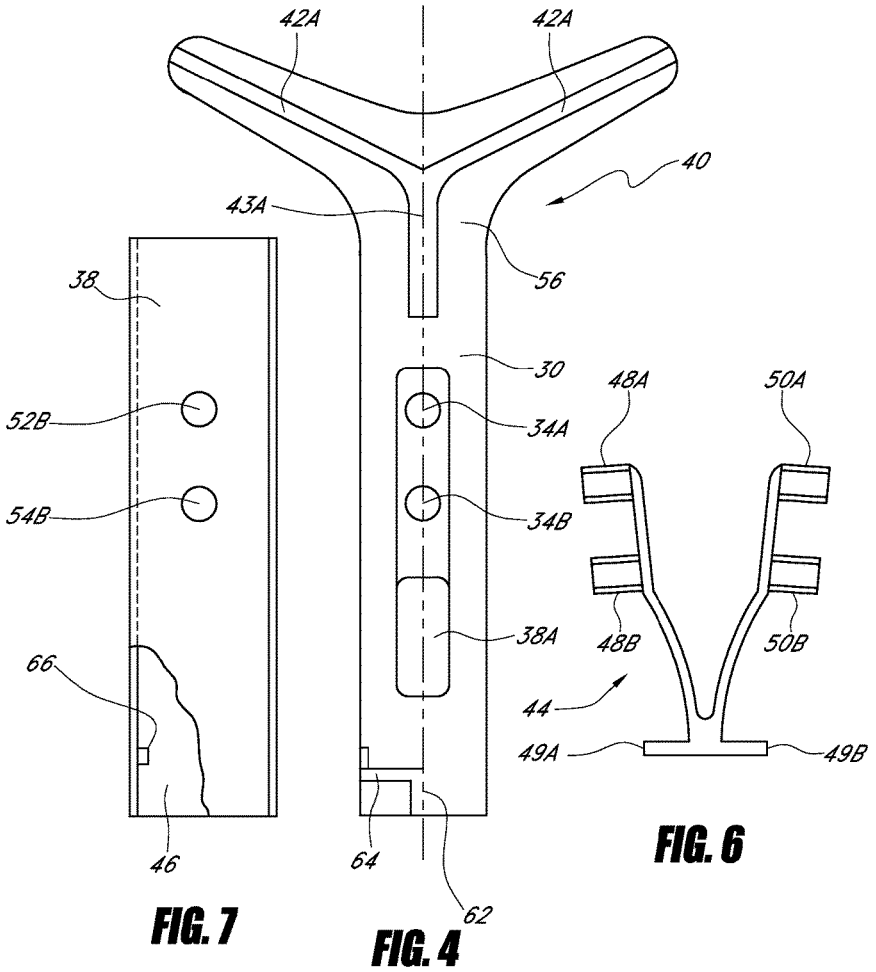
FIG. 6
FIG. 7
FIG. 4

MODULAR DESIGNED POOL CLEANING TOOL

CROSS-REFERENCE TO RELATED APPLICATIONS

This application is a continuation-in-part of U.S. application Ser. No. 11/618,965, filed on Jan. 2, 2007, which is hereby incorporated by reference in its entirety.

BACKGROUND OF THE INVENTION

Field of the Invention

This invention relates to cleaning tools, and in particular to a modularly designed cleaning tool such as a pool brush used for pool cleaning and maintenance.

Description of the Related Art

Prior art devices, sometimes called "pool rakes, leaf nets or skimmers", generally include a neck or stem/handle apparatus to engage long tubular handle or extended pole and a frame, the frame having an opening that is covered with a net. The net is retained on the frame by a retaining means including typically techniques, such as using clip various devices or using a folding/attachment design that allows threading over the frame. To accommodate the pool professional, there has been an attempt to employ an approach to attempt to permit replacement of parts of the rakes that tend to wear out during normal use. Such devices sometimes include a replaceable net sized and configured to fit a frame, a replaceable elongated sleeve clip to hold the net to the frame, and attachment means designed to attach the frame to a handle or pole.

These prior art attempts to permit disassembly and replacement of various parts have been less than satisfactory. One disadvantage of the prior art devices is that they require assembly or disassembly of the rakes with using various tools. Usually the first step in disassembling the rake for replacement of part requires the removal sleeve clip from the frame using a screwdriver, wrench or other tool. Sometimes this removal is so awkward or difficult that the net, the frame, and/or the clip itself can be further damaged or destroyed during the operation, or the user's hands can be injured.

Another disadvantage of the prior art pool leaf rakes is that the neck is not adequately designed to withstand the forces that are generated during normal use, and therefore breakage at the neck of the attachment point which engages the frame and the handle or pole frequently occurs. This results in catastrophic failure of the neck requiring replacement several of the pool rakes components or more commonly, complete replacement of the entire unit (and disposal of the original unit).

In addition to pool leaf rakes, pool brushes are also commonly used for pool cleaning and maintenance. The brushes are used to remove dirt and algae from the walls and floor of the swimming pool. Pool brushes generally include a brush head attached to an elongate handle. During use, a large amount of downward and transverse force is applied to the brush head via the handle in order to move the brush through water. The force imparted during use often causes the pool brush to break, particularly at the neck area between the brush head and handle. To reduce breakage, conventional brush heads are all constructed with a reinforced metal backing. Disadvantageously, the metal backing increases manufacturing cost and is not very effective at significantly reducing breakage of pool brushes. In particular, cracks and stress fractures still commonly occur at the joint area between the handle and brush head as well as along the brush head even with reinforced with metal backing. As such, there is a need for an improved pool brush that is designed to better withstand stress and force applied to the brush during use.

SUMMARY OF THE INVENTION

The preferred embodiments of the invention provide a modularly designed cleaning tool having a reinforcement member designed to couple with the brush head and handle in a manner such that sufficient reinforcement is provide that metal backing on pool cleaning tools such as pool brushes can be eliminated. In some implementations, the tool further comprises removable corner brushes with built-in magnets adapted for picking up magnetic debris in the pool so as to eliminate the need for a separate tool for such debris.

In one embodiment, the modularly designed tool comprises a brush head, a stem assembly extending outwardly from the brush head, and a reinforcement member disposed in the neck area where the brush head and stem assembly meet. The brush head comprises an elongate frame and bristles extending therefrom. The reinforcement member comprises a first sidewall, a second sidewall, and an adjoining collar portion, wherein the sidewalls of the reinforcement member are disposed at an angle and form a channel that receives at least a portion of the elongate frame of the brush head in a manner such that the first sidewall is positioned to exert force against the upper surface of the frame and the second sidewall is positioned to exert force against the interior sidewall of the frame when the tool is used. The collar portion is adapted to circumscribe the stem assembly and comprises an apron, wherein the apron and the stem assembly define an annular space adapted for receiving a distal end of a tubular handle, such as a telescopic pole. In some implementations, the annular space has a depth of between about 1 mm to 5 mm, or between about 2 mm to 3 mm. Extension of the end of the tubular handle into the annular space defined by the apron reinforces the joint area between the handle and the brush head and reduces breakage of the tool.

In another embodiment, the modularly designed cleaning tool generally comprises a brush assembly having an elongated frame and bristles extending therefrom; a stem assembly connected to the brush assembly at a neck area; a reinforcement member, such as a reinforcement collar, disposed in the neck area; and an elongated tubular handle adapted to extend over the stem assembly and into a space between the reinforcement member and the stem assembly. In one embodiment, the elongated tubular handle extends into an annular space between the reinforcement member and the stem assembly. In another embodiment, magnets are disposed on an outer surface of the elongated frame so magnetic debris can be picked up while the brush is applied against a surface such as the pool wall. In yet another embodiment, the removable corner brushes is adapted to slidably engage with the frame of the brush.

In yet another embodiment, the invention provides a reinforcement fitting adapted for reinforcing a pool cleaning tool having an elongate handle. The reinforcement fitting comprises a collar and an adjoining shell. The collar comprises an apron portion having a diameter greater than the diameter of the collar. The adjoining shell extends laterally from the collar, wherein the shell comprises a first sidewall and a second sidewall, wherein the sidewalls are disposed at an angle relative to each other. In some implementations, the first sidewall comprises two downwardly sloping exterior surfaces extending from opposing sides of the collar and the second sidewall comprises an elongate exterior surface that extends along an axis transverse to the longitudinal axis of the collar.

It will be appreciated that the modularly designed cleaning tool can be used in connection with a variety of different implements such as brushes, rakes, nets, or the like, and also can be used in a variety of different applications in addition to pool cleaning.

BRIEF DESCRIPTION OF THE DRAWINGS

FIG. 4 is a sectional showing an inner view of the top stem assembly showing the "Y" configured frame track and the rectangular shaped clip track having a sliding slot, a pair of holes to receive the double-buttoned pole sleeve retaining clip, and an insertion and securing groove.

FIG. 5 is a cross-section taken from FIG. 3 which shows a front view of the top stem assembly and the frame retention track.

FIG. 6 shows the double-buttoned pole retaining clip which includes a pair of protruding knobs positioned on each of two legs of the clip and clip base which as a width approaching the inside diameter of a tubular pole.

FIG. 7 shows the tubular sleeve with securing knob which is designed to keep the top and bottom stem assemblies securely engaged when in the coaxial cooperation position.

DETAILED DESCRIPTION OF THE PREFERRED EMBODIMENT

Figure 1:
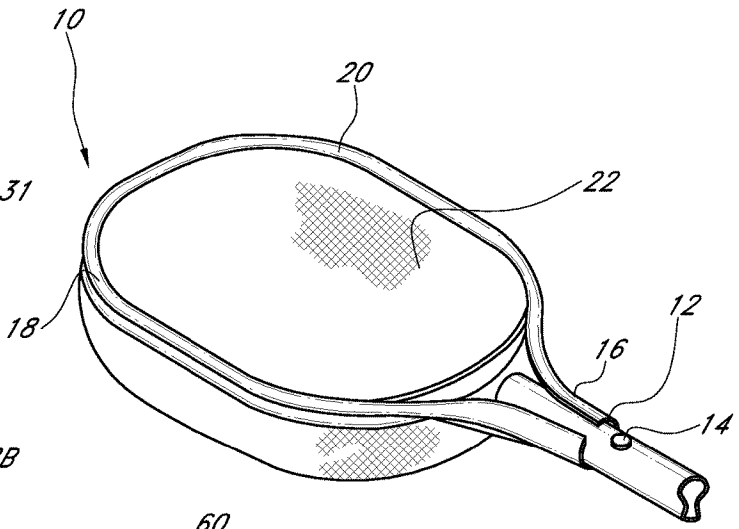
FIG. 1 is a pictorial view of a prior art pool leaf net showing the standard weak tubular pole to frame joint.

Referring to FIG. 1 which shows a pictorial view of a prior art rakes/nets 10. The prior art pool leaf net 10 includes a frame means 18 forming a mouth portion 22 and having conventional attachment means to the handle portion 12 with the ends of the frame secured to the attachment means 14. Also shown are the typical one pair holes 14 for attaching the prior art rakes/nets 10 to the distal end of an elongated pole member. In the preferred embodiment, the frame is generally fabricated from steel or aluminum or other suitably strong, lightweight, cost-effective material.

The prior art rakes/nets typically suffer from weak tubular pole to frame joints which are not adequately designed to withstand the forces that are generated during normal use. The prior art leaf nets 22 generally have a polymer weave and a retaining means 20 for securing the end of the net 22 to the frame 18, designed to allow water but capture debris and leave. Breakage at the neck 16 of the attachment point which engages the frame portion 18 and the handle or pole frequently occurs. This results in catastrophic failure of the neck 16 requiring replacement several of the pool rakes components or more commonly, complete replacement of the entire unit (and disposal of the original unit).

Figure 2:
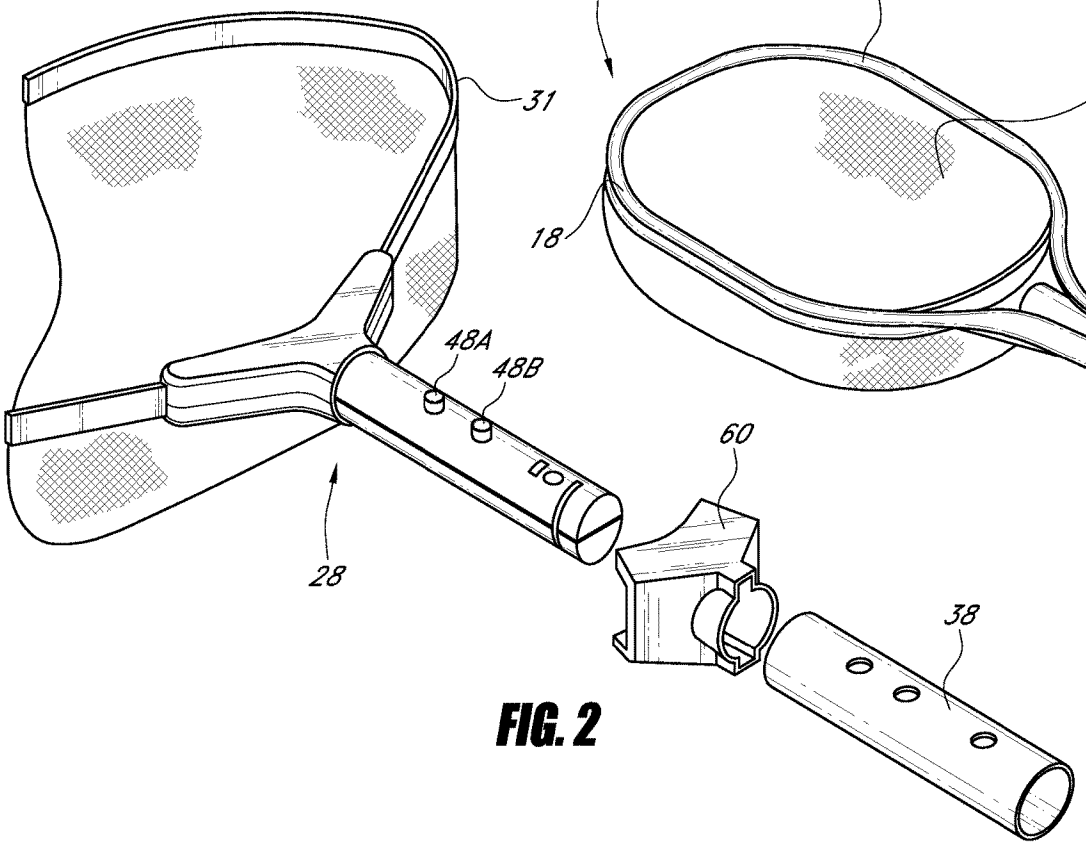
FIG. 2 is a partial exploded view of the modular designed present invention showing the general reinforced neck portion with extended handle, an optional brace, and the locking tubular sleeve.

As shown in the partial exploded view of FIG. 2, in general, the modular designed present invention 28 comprises a reinforced neck portion with extend handle portion having a pair of retaining knobs 48*a* and 48*b* projecting from the extended handle portion designed to engaged the holes of the tubular sleeve 38.

In addition, as typical for pool equipment manufacturers, an optional pool apparatus whereby manufacturers include professional lines which generally has strengthen features. Shown is FIG. 2 is one such feature where an optional support brace 60 designed to cooperate with the present invention and providing additional strengthen to the neck area which, as described in the prior art, is the weak link in pool leaf nets.

Also shown in partial detail is the frame 31 which extends beyond the joined and secured top 40 and bottom 41 stem assemblies forming an open mouth portion which is covered by net member. The typical net member is fabricated frown any appropriate material, and is sized and configured to correspond with the mouth opening and to be able to retain a desired quantity of debris which may be collected in the net during use of the present invention. The net member is preferably of conventional materials and construction and is preferably configured as a bag with an opening at one end. In one example, the net is fabricated with an elongated pocket located on the upper rim which is designed to thread over the frame, when disassembled, providing a user-friendly replacement technique. The elongated pocket is fabricated by folding over a portion of the net to form the elongated pocket and maintaining this configuration using typical sowing or adhesive attached techniques. In another example, the net member is held or retained in operative relationship with the frame by using an elongated retaining strip. The strip is preferably fabricated from plastic (such as polypropylene, polyethylene, butyrate, or the like) or other suitably tough, flexible, resilient, lightweight material having sufficient shape-memory to be snapped onto, and removed from, the frame means as described herein. The channel or strip is generally U-shaped in cross-section.

The particular materials and dimensions of the frame means can be readily determined without undo experimentation for any particular size of tool, by persons of ordinary skill in the art. In addition to the preferred stainless steel material, the frame means can be fabricated from aluminum, plastic, or similar lightweight, flexible, resilient material.

Figure 3:
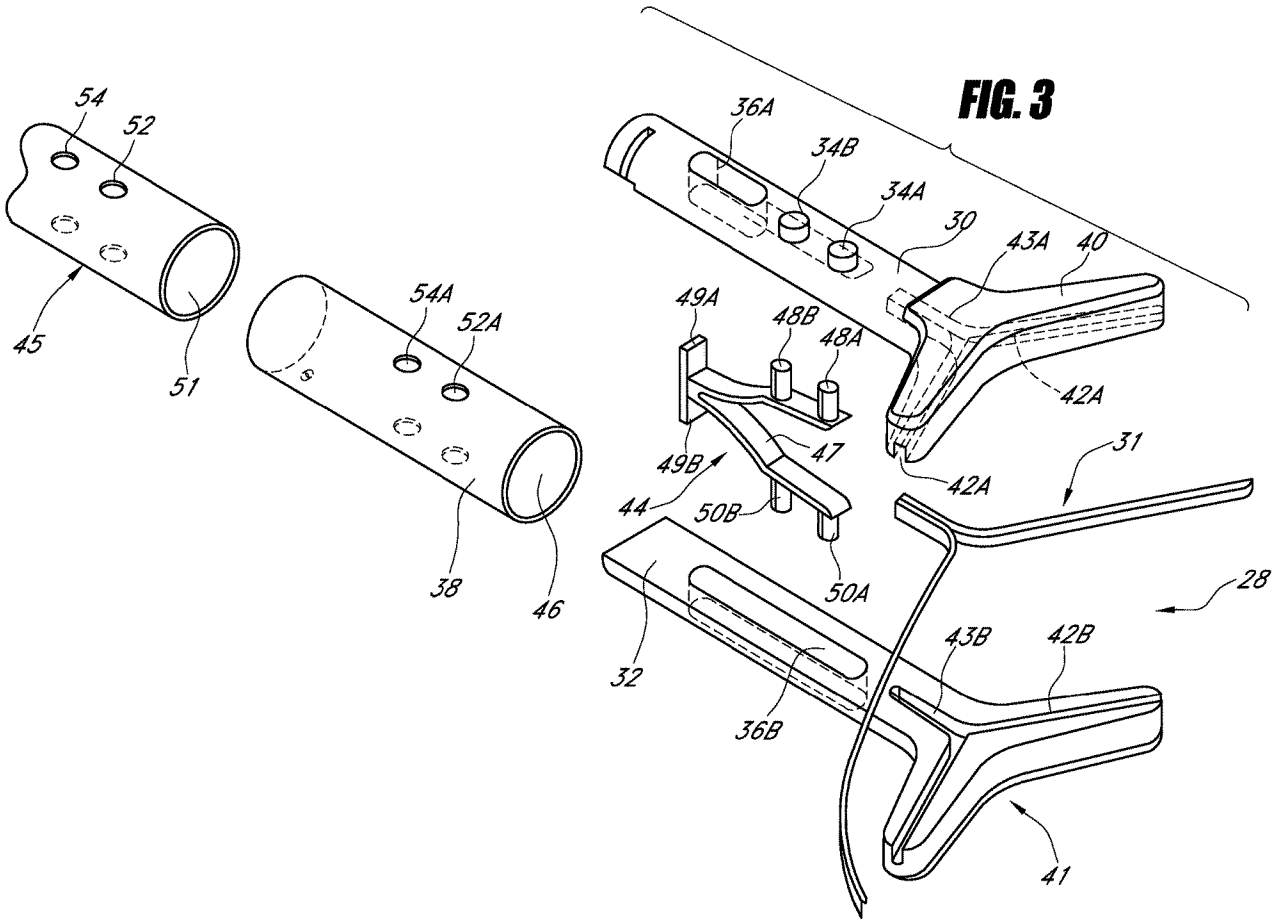
FIG. 3 is a exploded view of the modular design present invention showing a top stem assembly having a top frame trace a bottom stem assembly having a bottom frame track, a buttoned pole retaining clip, a portion of the pole, and the proximal "Y" shaped portion of the frame assembly.

Now referring to FIG. 3 is a exploded view of the modular design present invention showing a top stem assembly 30 having a top frame track 42*a*, a bottom stem assembly 32 having a bottom frame track 42*b*, a double-buttoned sleeve and pole retaining clip 44, a distal portion of the extended pole or handle 38. The proximal "Y" shaped area of the frame assembly is designed to receive the double jointed and bonded proximal end of the frame 31.

The top stem assembly 40 may be formed of a rigid polymeric material consisting of polypropylene, Nylon, Dacron, Delrin, synthetic polyamide, polytetrafluroethylene (PTFE), polyethylene, butyrate or other suitably tough, flexible, resilient, lightweight material having sufficient high tensile strength materials such as Vectran™, Kevlar™. In addition, the top stem assembly 40 may be formed from a metallic material such as steel, aluminum, or stainless steel materials. The top stem assembly 40 is machined or molded using typical machining and molding techniques to provide the "Y" shaped groove for receiving and engaging half of the diameter of the frame. The "Y" shaped groove has a pair of extending top groove portions 42*a* and top base portion 43*a*. The top stem assembly 40 also has a pair of holes 34*a* and 34*b* which penetrated the diameter of the top stem assembly 40 which receive and engage a pair of knobs 48*a* and 48*b*, or 50*a* and 50*b*, from a buttoned pole retention clip 44. A top distal sliding slot 36*a* is also machined or molded into the top stem assembly 40 which penetrates the diameter of the top stem assembly 40 and is designed to engage and contain a pair of extended base pieces 49*a* and 49*b* on the buttoned pole retention clip 44. Also shown is a proximal cut-tout area 36*a* near the pair of holes 34*a* and 34*b*.

Also shown in FIG. 3 is the double buttoned sleeve and pole retaining clip 44 which includes a pair of protruding knobs 48*a* and 48*b*, and 50*a* and 50*b*, positioned on each of two legs of the clip 44. The double-buttoned sleeve and pole retaining clip 44 has a pair of extended base pieces 49*a* and 49*b* which extend slightly beyond the limits of the top stem assembly 40 distal sliding slot 36*a* and has a width approaching the inside diameter of a tubular pole or handle 38. It is anticipated by the Applicant that other types of retaining clips, including the standard single pair design used with prior art devices, having one or more protruding buttons can be specifically designed to also work with the present invention.

The bottom stem assembly 41 may be formed of a rigid polymeric material consisting of polypropylene, Nylon, Dacron, Delrin, synthetic polyamide, polytetrafluroethylene (PTFE), polyethylene, butyrate or other suitably tough, flexible, resilient, lightweight material having sufficient high tensile strength materials such as Vectran™, Kevlar™. In addition, the bottom stem assembly 41 may be formed from a metallic material such as steel, aluminum, or stainless steel materials. The bottom stem assembly 41 is machined or molded using typical machining and molding techniques to provide the "Y" shaped groove for receiving and engaging half of the diameter of the frame. The "Y" shaped groove has a pair of extending top groove portions 42*b* and top base portion 43*b*. A extended bottom distal sliding slot 36*b* is also machined or molded into the bottom stem assembly 41 which penetrates the diameter of the bottom stem assembly 41 and is designed to engage and contain a pair of extended base pieces 49*a* and 49*b* on the buttoned pole retention clip 44.

Also shown in FIG. 3 is the tubular sleeve 38 has an inside diameter 46 which is slightly smaller than the diameter that results when the top assembly 40 and bottom assembly 41 are joined. The tubular sleeve 38 is designed to keep the top and bottom stem assemblies securely engaged when positioned coaxially over the modularly designed top 40 and bottom 41 structures. The tubular sleeve 38 is fitted with a pair of distal holes 52*a* and proximal holes 54*a* on each side of the tubular structure is designed to receive retaining clip knobs 45*a* and 48*b* on one side, and 50*a* and 50*b* on the other side. Once the tubular sleeve 38 is positioned over the top and bottom assemblies, it is rotated approximately 45 degrees whereby the pair of holes 52*a* and 54*a* lines up with the retaining clip knobs 48*a*, 48*b*, 50*a*, and 50*b*. The present invention 28 is now ready for use by the operator. Optionally, an elongated pole 45 with a inside diameter 51 which is slightly larger that the outer diameter of the tubular sleeve 38, can be coaxially slide over the tubular sleeve and secured with the appropriate knobs inserted into the pair of holes 54 and 52.

FIG. 4 shows, in more detail, the inner details of the top stem assembly 40. The top stem assembly 40 has a "Y" configured frame trail 42*a* and second joint portion 43*a* and the rectangular shaped clip track having a sliding slot 36*a* and a pair of holes 34*a* and 34*b*. The area around the neck region of the stern is heavily reinforced by using substantially rigid materials with substantial girth or mass to reduce flexing and inhibit the formation of fatigue fractures at this weak point. The "Y" shaped groove 42*a* and 43*a* in the top stem assembly 40 is adapted to tightly enclose approximately one half of the width a rectangular or planar shaped frame. In addition, a butted joint assembly of two rectangular or planar frame end pieces can be joined by welding, adhesive or other technology and fitted with the second joint portion 43*a*. The rectangular shaped clip track having a sliding slot 36*a* and a pair of holes 34*a* and 34*b* are designed to receive and cooperate with the double buttoned sleeve and pole retention clip 44.

Located on the proximal end of the handle portion of the top stem assembly 40 is a insertion groove 62 and a securing groove 64, which is designed to engage a securing knob 66 located in the inside wall of the tubular sleeve 38 (shown in more detail in FIG. 7).

FIG. 5 is a cross-section taken from FIG. 3 which shows a front view of the top stem assembly and the frame retention track.

Figures 8, 9, 10, 11, 12:
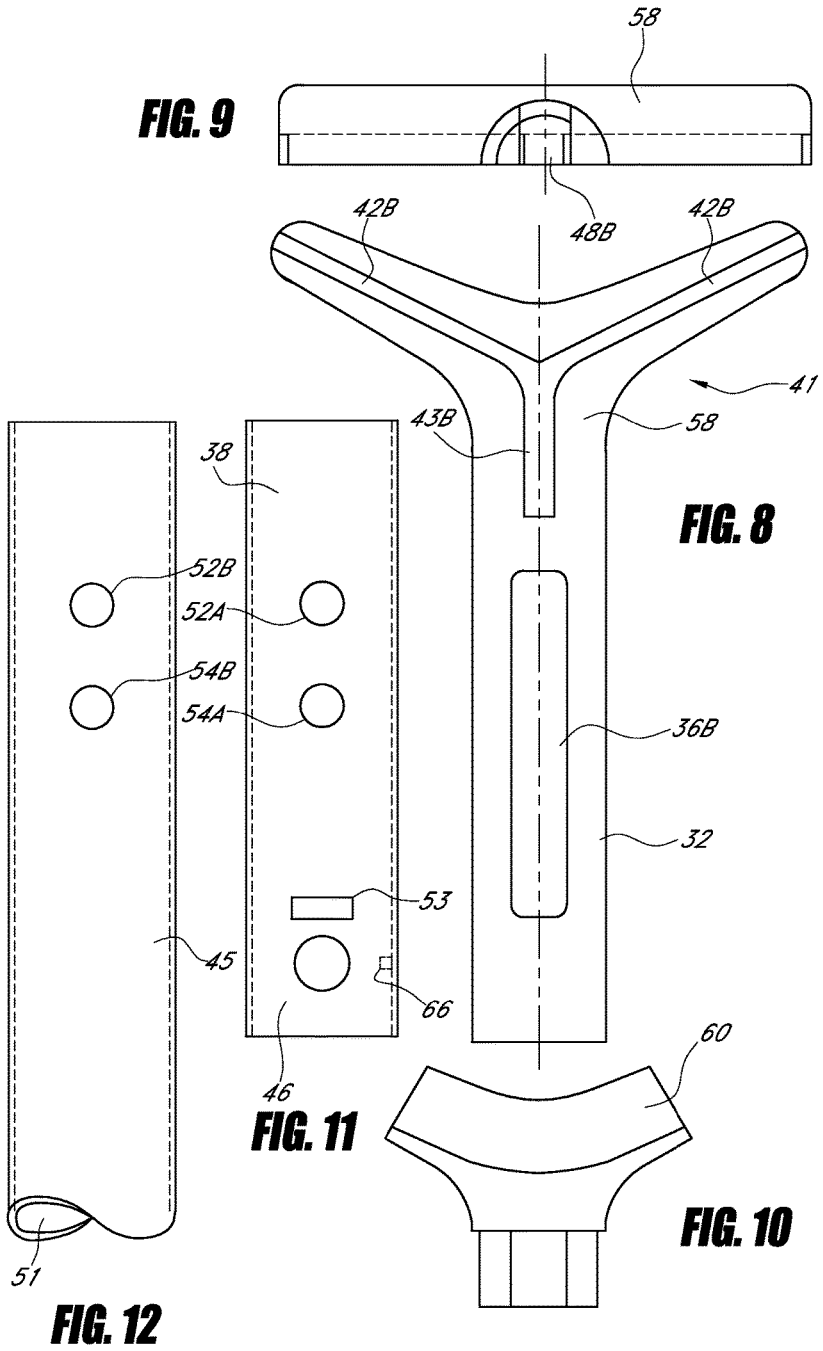
FIG. 8 is sectional showing the an inner view of the bottom stem assembly showing the "y" configured frame track and the rectangular shaped clip track having a sliding slot.
FIG. 9 is a cross-section taken from FIG. 5 which shows a front view of the bottom stem assembly frame retention track.
FIG. 10 is a perspective view of the optional stem support brace.
FIG. 11 shows another view of the tubular sleeve with securing knob which is designed to keep the top and bottom stem assemblies securely engaged when in the coaxial cooperation position.
FIG. 12 show a distal portion of the tubular pole with two pairs of holes designed to receive the retaining clip protruding knobs for securing the present invention modular handle/net apparatus to an elongated pole assembly.

FIG. 6 shows the preferred double-buttoned sleeve and pole retaining clip 44 which includes a pair of protruding knobs 48*a* and 48*b*, and 50*a* and 50*b*, positioned on each of two legs of the clip. The retaining clip 44 is designed to be sandwiched between the top stem assembly 40 and bottom stem assembly 41, and cooperate with first guide hole 36*a* and holes 34*a* and 34*b* of the top stem assembly 40 and the second guide hole in the bottom stein assembly (FIG. 8). The base of the retaining clip 44 has a pair of ears 49*a* and 49*b* which have a width that approaches the inside diameter of the tubular sleeve. It is anticipated by the Applicant that other types of retaining clips, including the standard single pair design used with prior art devices, having one or more protruding buttons can be specifically designed to also work with the present invention.

FIG. 7 shows the tubular sleeve with securing knob which is designed to keep the top and bottom stem assemblies securely engaged when in the coaxial cooperation position. Once the tubular sleeve 38 is positioned over the top and bottom stem assemblies 40 and 41 respectively, the sleeve is rotated approximately 45 degrees whereby the securing knob 66 follows first the insertion groove 62 and then, upon rotation, follows the securing groove 64, thereby providing additional securing means.

FIG. 8 is a sectional showing the inside view of the bottom stem assembly 41 having a "Y" configured frame track 42*b* and second joint portion 43*b* and an elongated rectangular shaped clip track sliding slot 56*b*. The area around the neck region of the stem is heavily reinforced by using substantially rigid materials with substantial girth or mass to reduce flexing and inhibit the formation of fatigue fractures at this weak point. The "Y" shaped groove 42*b* and 43*b* in the bottom stem assembly 41 is adapted to tightly enclose approximately the other one half of the width a rectangular or planar shaped frame. In addition, a butted joint assembly of two rectangular or planar frame end pieces can be joined by welding, adhere or other technology and fitted with the second joint portion 43*b*. The rectangular shaped clip track sliding slot 56*b* is designed to receive and cooperate with the double-buttoned retention clip 44.

FIG. 9 is a cross-section taken from FIG. 5 which shows a front view of the bottom stem assembly frame retention track.

FIG. 10 is a perspective view of the optional stem support brace 60. Typically pool equipment manufacturers offer an optional pool rakes whereby manufacturers include professional lines which generally have improved features. The optional support brace 60 is an improved feature designed to cooperate with the present invention and providing additional strengthen to the neck area which, as described in the prior art, is the weak link in pool leaf nets.

FIG. 11 shows another view of the tubular sleeve 38 with securing knob 66 on the inside surface of the lumen which is designed to keep the top and bottom stem assemblies securely engaged when coaxially engaging the top stem assembly 40 and the bottom stem assembly 41. Once the tubular sleeve 38 is positioned over the top and bottom stein assemblies 40 and 41 respectively, the sleeve is rotated approximately 45 degrees whereby the securing knob 66 follows first the insertion groove 62 and then, upon rotation, follows the securing groove 64, thereby providing additional securing means.

FIG. 12 show a distal portion of the tubular pole 45 with two pairs of holes 54*b* and 52*b* designed to receive the retaining clip protruding knobs for securing the present invention modular handle/net apparatus to an elongated pole assembly.

Modular Engagement and Operation

Persons of ordinary skill in the art will understand that, although the present embodiment comprised of several sections, the modular design allows for easy assembly and disassembly and further the engage of the modular components allows for efficient service in the field. When the distal end of the locking sleeve 38 is coaxially inserted over the joined upper stem assembly 40 and bottom stem assembly 41, and secured by the enclosed multi-buttoned sleeve and pole retention clip 44, the proximal section of the frame member 31 is securely engaged within the upper and lower frame tracks. The present invention now provides a robust neck and stem assembly for pool cleaning operations.

Once the leaf net assembly is introduced into approximate conformance with the surface or pool volume to be cleaned, the present invention assembly is pushed across that surface or pool volume to capture debris in the net.

The modular handle/net apparatus and method of the preferred embodiments has been described with some particularity but the specific designs, constructions and steps disclosed are not to be taken as delimiting of the invention in that various modifications will at once make themselves apparent to those of ordinary, skill in the art, all of which will not depart from the essence of the invention and all such changes and modifications are intended to be encompassed within the appended claims.

Figure 13A:
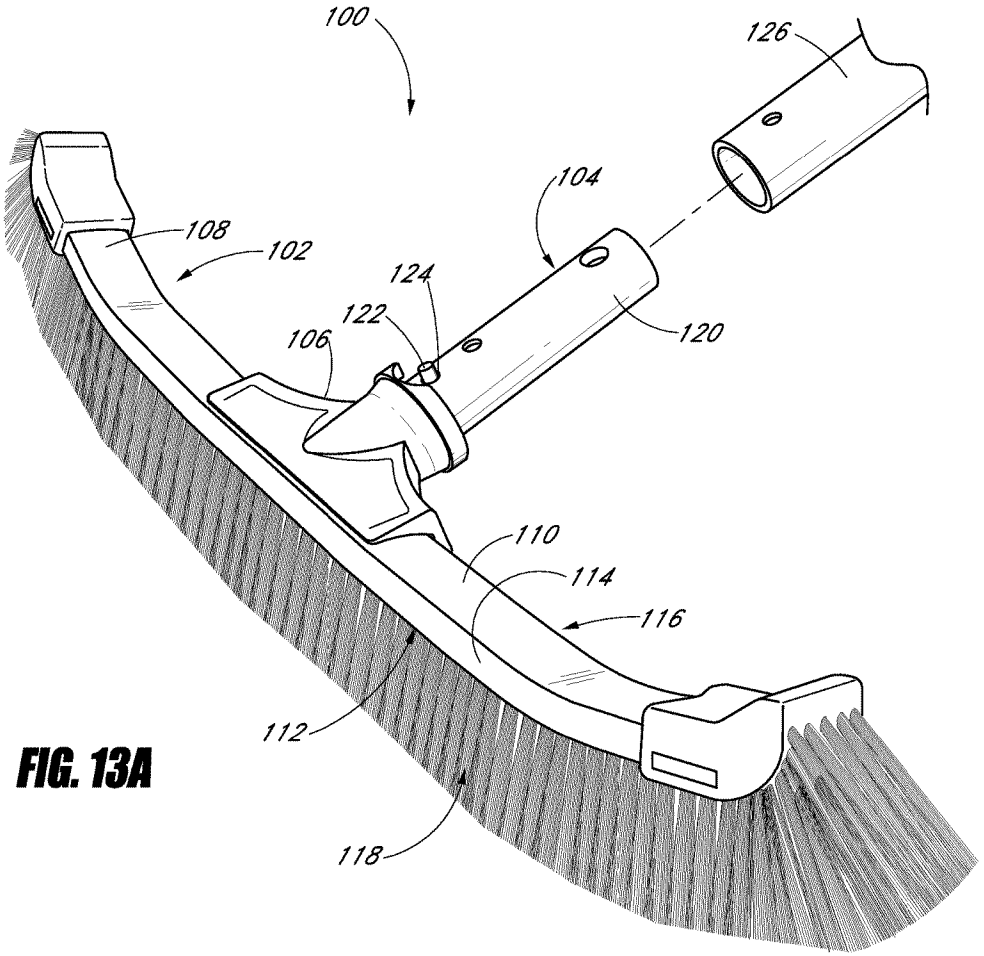
FIGS. 13A, 13B, and 13C illustrate perspective views of a modular cleaning tool of one embodiment.

FIG. 13A illustrates another embodiment of the present disclosure, showing a modular cleaning tool 100 that can be used for cleaning the walls and floors of swimming pools. The modular cleaning tool 100 is adapted to couple with a standard elongate handle such as a telescopic pole used for various pool cleaning implements. However, it will be appreciated that the inventive features of the modular cleaning tool can have applications outside the pool cleaning and maintenance field. As will be described in greater detail below, the modular cleaning tool 100 is designed to reduce breakage while substantially eliminating the need for a metal back reinforcement that is normally required for pool brush assemblies. The modular cleaning tool 100 is also designed with removable corner brushes having built-in magnets adapted to picking up magnetic debris such as hair pins while the brush is applied across a pool floor, which advantageously eliminates the need to use a separate tool for picking up such debris.

As shown in FIG. 13A, the modular cleaning tool 100 generally comprises a brush head 102, a stem assembly 104 extending outwardly from the brush head 102, and a reinforcement member 106 configured to provide sufficient reinforcement so that the modular cleaning tool 100 can withstand greater force and stress than conventional pool brushes with metal backing. As illustrated in FIG. 13A, the brush head 102 comprises an elongate support base 108 having an upper surface 110, a lower surface 112, and interior and exterior side surfaces 114, 116. Bristles 118 extend from the lower surface 112 of the support base 108 at an angle relative to the stem assembly 104 to form a brush for scrubbing and removing dirt from walls and floors of swimming pools and the like. The stem assembly 104 has a generally tubular body 120 with one or more buttons 122 extending through openings 124 formed on the tubular body 120. As will be described in greater detail below, the buttons 122 are adapted to engage with corresponding openings on an elongate handle 126, such as a telescopic pole, to removably attach the handle to the modular cleaning tool 100.

Figure 13C:
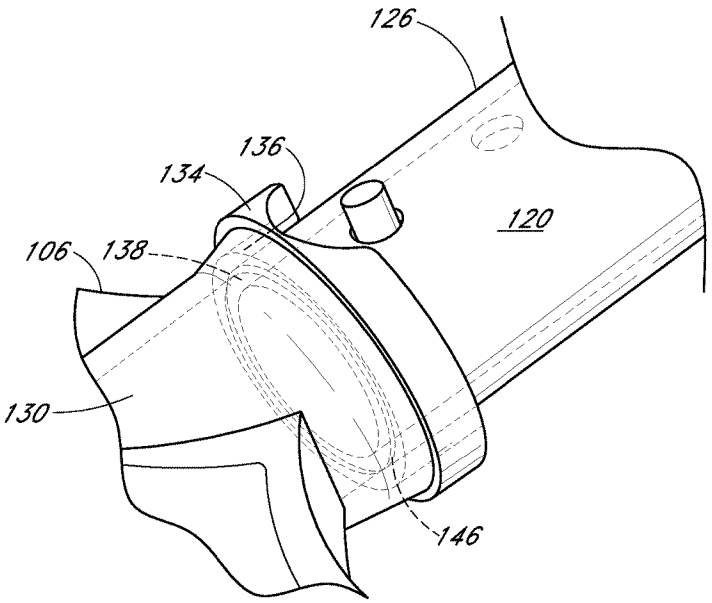
Figure 13B:
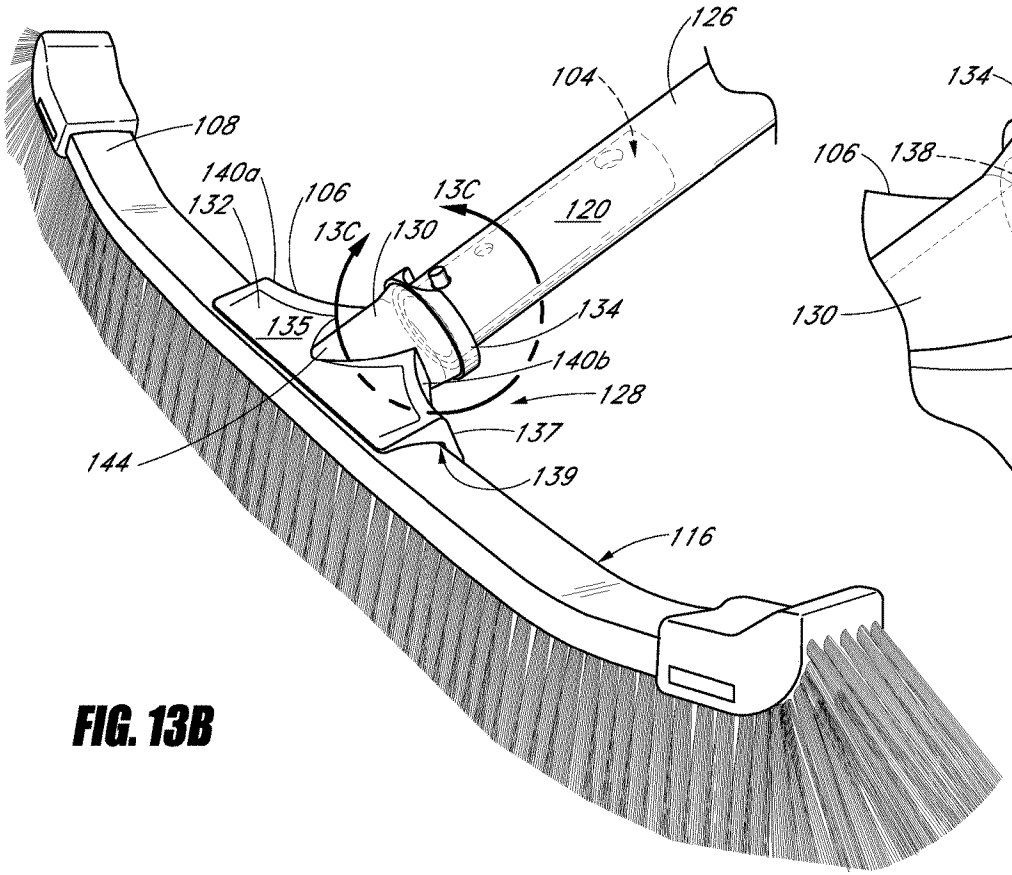

As illustrated in FIG. 13B, the reinforcement member 106 is configured to be positioned in the neck area 128 of the tool 100 where the support base 108 and the stem assembly 104 are joined. In one implementation, the reinforcement member 106 is configured with a collar portion 130 and an adjoining shell 132. The collar portion 130 is sized to circumscribe the tubular body 120 of the stem assembly 104 and has an apron 134 forming an annular space 136 around the tubular body 120. The annular space 136 is configured to receive a proximal end 138 of the elongate handle 126. As further illustrated in FIG. 13B, the shell 132 of the reinforcement member 106 is preferably configured to conform to the general contour of the neck area 128 of the tool 100. In one embodiment, the shell 132 comprises two sidewalls 135, 137 extending laterally from the collar portion 130 and disposed at an angle relative to each other forming a L-shaped channel 139 adapted to receive a portion of the upper 108 and inner side surface 116 of the support base 102.

As shown in FIG. 13B, one sidewall 137 comprises two downwardly sloping surfaces 140*a*, 140*b* extending from opposing sides of the collar portion 130. Each of the two downwardly sloping surfaces 140*a*, 140*b* are preferably between about 1 mm to 4 mm wide. In certain preferred implementations, the reinforcement member 128 is configured with an opening, indentation, or protrusion 144 configured to facilitate installation or removal of the reinforcement member. In certain preferred implementations, the configuration and dimension of the reinforcement member is designed to improve the stress and force resistance and substitute the metal backs. When the reinforcement member 106 is coupled with the brush head 102, the reinforcement member 106 absorbs a certain amount of the force and stress applied to the brush head during use. Additionally, the first sidewall 135 of the reinforcement member is adapted to exert force against a span of the upper surface 110 of the support base 102 and the second sidewall 137 is adapted to exert force against a span of the interior sidewall 116 of the support base 102 so that the force and stress is diffused over a larger area. In one embodiment, the reinforcement member has a length of approximately 100 mm-150 mm and the shell has a thickness of between 1 mm to 10 mm, more preferably between 3 mm to 5 mm. In another embodiment, the reinforcement member has a length that is between 20% to 40% of the length of the support base. In another embodiment, the height of the reinforcement member is between about 50 mm to 100 mm.

As further shown in FIGS. 13B and 13C, the reinforcement member 106 is disposed in the neck area 128 of the tool 100 and adapted to receive the distal end 138 of the elongate handle 126. In one embodiment, the distal end 138 is inserted into the annular space 136 defined by the apron 134 of the reinforcement member and the stem assembly by about 1 mm-10 mm, more preferably between 2 mm-5 mm. In some embodiments, inserting the elongate handle 126 into the apron causes the force applied from the handle to be transferred to the reinforcement member as opposed to the brush head or neck portion. This in turn significantly reduces breakage of the brush head or neck portion. In one embodiment, a shoulder 146 is formed in the interior of the collar portion 130 at a point slightly below the apron 134, which serves as a stopper guide for insertion of the handle 126.

Figure 15:
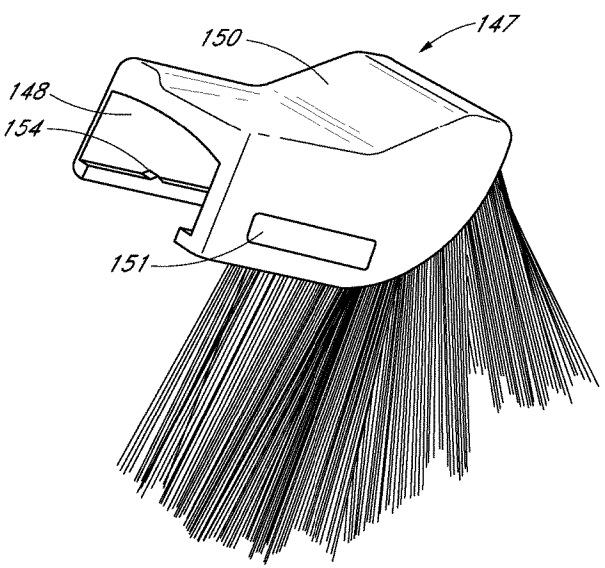
FIG. 15 is a detailed view of a removable corner brush, showing the internal tracks adapted to slidably engage with a brush frame.
Figure 14:
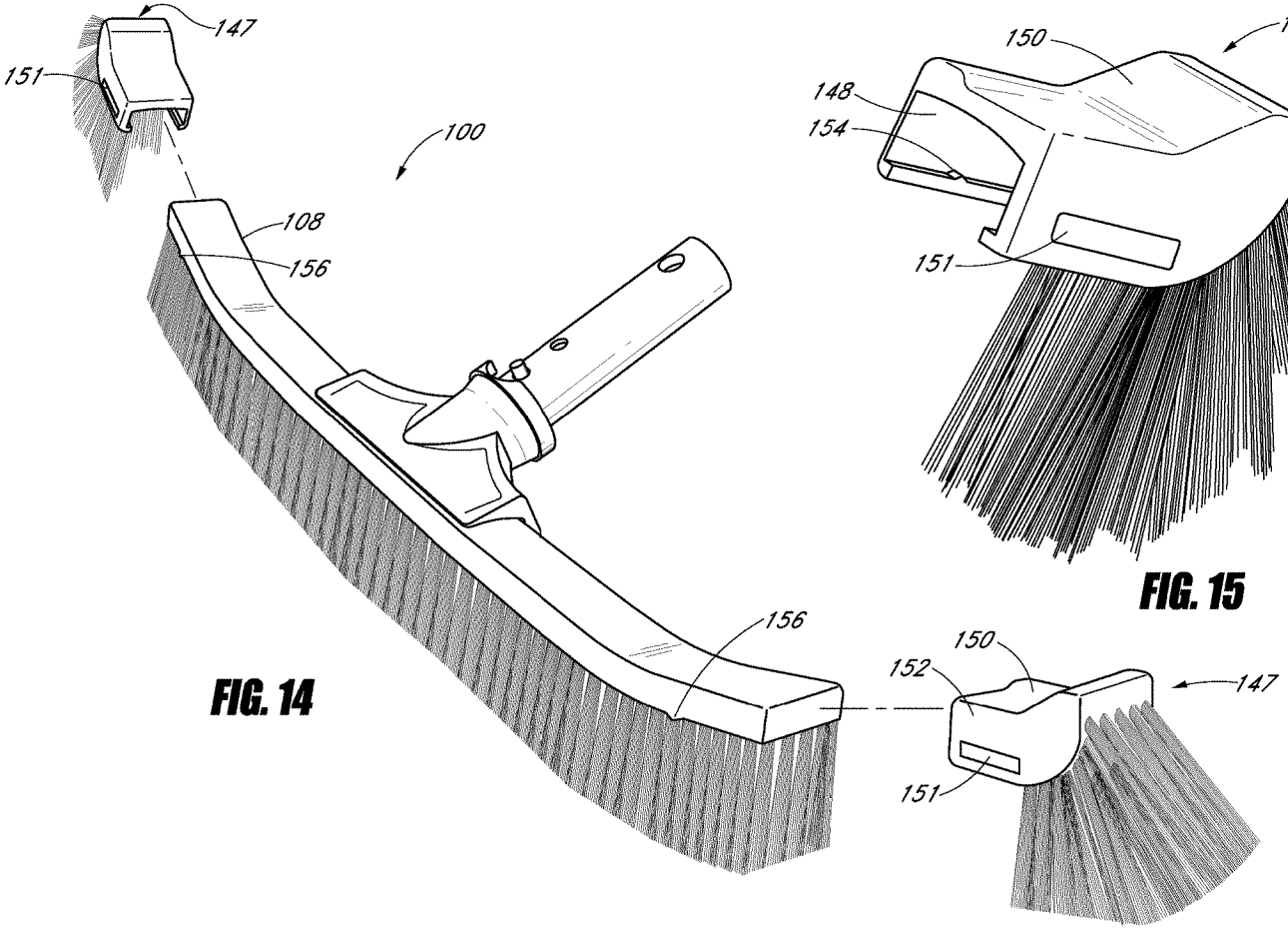
FIG. 14 illustrates a modular designed cleaning tool of one embodiment having removable corner brushes.

In some embodiments as shown in FIG. 14, the modularly designed cleaning tool 100 further comprises removable corner brushes 147 that slidably engages with the end portions of the base support 108. In one implementation, each corner brush 147 comprises a U shaped track 148 and a upwardly curving support surface 150 from which bristles extend as shown in FIG. 15. In some implementations, each corner brush 147 comprises one or more built-in magnetic attachments 151 adapted to pick up magnetic debris in water. Preferably, the magnetic attachments 151 are disposed on an exterior sidewall 152 of the corner brush 147. In some embodiments, magnetic attachments can also be disposed on the base support 108 of the brush head. In certain preferred implementations, a notch 154 or other location indicator is formed on the track of the corner brush 147 to engage with a corresponding notch 156 or other location indicator formed on the brush support 108 to secure the corner brush to the brush head at the desired location.

Figure 16A:
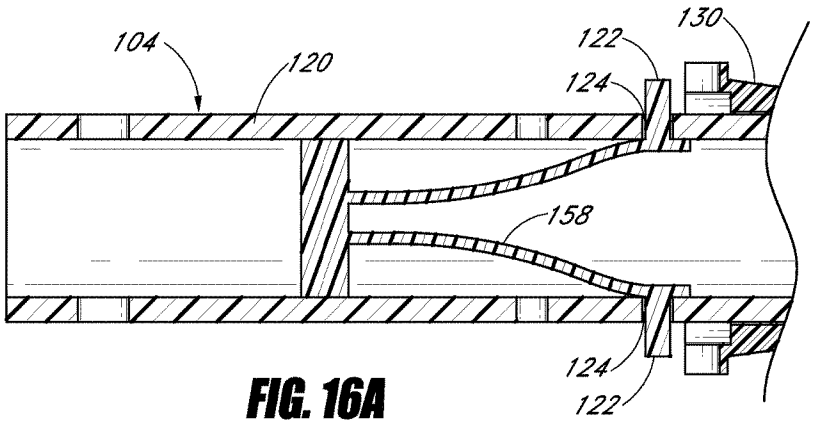
FIGS. 16A and 16B illustrate partial cross sectional views of the cleaning tool, showing the pole extending into the reinforcement collar.
Figure 16B:
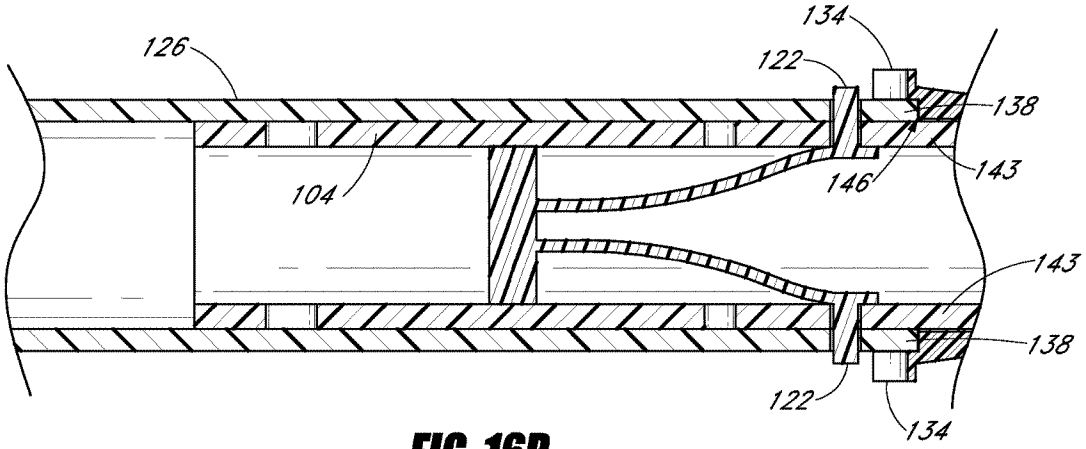

FIG. 16A illustrates a cross-sectional view of the stem assembly 104 engaged with the collar portion 130 of the reinforcement member 106. As shown in FIG. 16A, the stem assembly 104 includes a tubular body 120 enclosing a buttoned clip 158 that is disposed vertically inside the tubular body 120 when the reinforcement member fits over the stem assembly 104. Buttons 122 on the clip 158 are spring biased to extend outwardly from openings 124 formed on the tubular body 120. The spring biased buttons are adapted to engage with openings on the elongate handle and retain the handle in place. While FIG. 16A illustrates a two buttoned clip, other spring biased button clip systems such as the double-buttoned sleeve and pole retaining clip shown and describe above for pool rakes can also be used in this implementation. FIG. 16B provides a cross-sectional view of the stem assembly 104 when engaged with an elongate handle 126. As shown in FIG. 16B, the handle 126 is secured in position by engaging with the buttons 122 on the stem assembly 104. The distal end 138 of the handle 126 is inserted into annular space 136 between the apron 134 and the out walls 143 of the stem assembly. In one implementation, the distal ends 138 is pushed up against the shoulder stop guide 146. The should stop guide 146 prevents the handle from being jammed into the stem assembly and damaging the brush support base. Advantageously, insertion of the handle into the apron of the stem assembly coupled with the design of the reinforcement member provides significant reinforcement in the joint area between the handle and the brush head.

Figure 17:
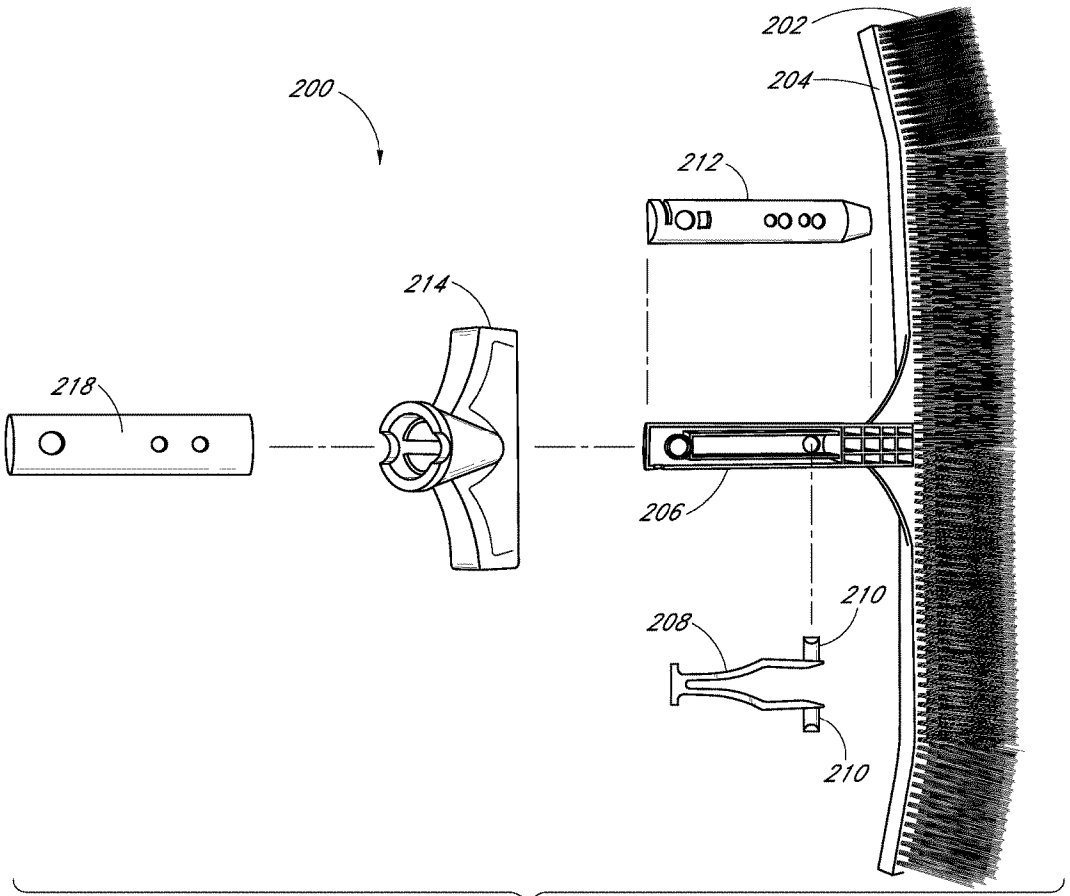
FIG. 17 illustrates the modular designed cleaning tool in a disassembled state.

FIG. 17 illustrates a modular cleaning tool 200 of one embodiment in a dissembled form. As shown in FIG. 17, the tool 200 comprises brush head 202 having a support base 204 that includes an integrally formed half tube section 206 adapted to receive a buttoned clip 208. The buttoned clip 208 is adapted to be positioned inside the half tube section 206 with the buttons 210 extending outwardly in a direction perpendicular to the longitudinal axis of the brush head 202. The tool 200 further comprises a second half tube section 212 adapted to mate with the integrally formed half tube section 206 in a manner such that the spring biased buttons 210 extend outwardly through the openings on the two half tube sections. The tool 200 further comprises a reinforcement member 214 adapted to extend through the tube sections 206, 212 and fit over the joint area 216. The tool 200 further comprises a tubular sleeve 218 that fits over the half tube sections 206, 212 to lock the half tube sections in position. As illustrated, the tool 100 can be easily assembled and disassembled. Furthermore, individual components such as the reinforcement member 214, tubular sleeve 218, or buttoned clips can be replaced. Additionally, the reinforcement member 214 is designed to provide sufficient reinforcement in the joint area that metal back reinforcement extending across the support base is no longer needed.

The foregoing description of the preferred embodiment of the present invention has shown, described and pointed out the fundamental novel features of the invention. It will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by appended claims.

What is claimed is:

1. A modularly designed cleaning tool, comprising:

a brush head comprising an elongate frame and bristles extending therefrom, said elongate frame having an upper surface, a lower surface, and two sidewalls extending therebetween, wherein the elongate frame comprises:

a middle portion;

a first distal portion connected to the middle portion; and a second distal portion connected to the middle portion opposite the first distal portion, wherein the first distal portion and the second distal portion extend from the middle portion at a first angle and a second angle, respectively, such that the lower surface at the first and second distal portions are angled relative to the lower surface at the middle portion, wherein the distal ends of the bristles together form a cleaning surface along the middle portion and the first and second distal portions of the elongate frame;

a stem assembly having a tubular configuration and extending outwardly from the brush head at an angle from the bristles, wherein the stem assembly and the brush head define a neck area, wherein the bristles extend from the lower surface at the middle portion such that the cleaning surface extends substantially perpendicular to the stem assembly along the middle portion, and wherein the bristles extend from the lower surface at the first and second distal portions such that the cleaning surface along the first and second distal portions is angled relative to the cleaning surface along the middle portion;

removable corner brushes each having a proximal end and a distal end, an upwardly curved surface near the distal end, the removable corner brushes each configured to receive the first or second distal portion of the elongate frame so that the removable corner brushes are detachably connected to the elongate frame, wherein the removable corner brushes comprise bristles extending generally away from the upwardly curved surface of the removable corner brushes in a manner such that bristles adjacent the distal end of the removable corner brushes extend outwardly at an angle different from the angle which bristles disposed at the first and second distal portions of the elongate frame extend to form an additional cleaning surface at the removable corner brushes, with the removable corner brushes on the elongate frame, and wherein the upwardly curved surface is angled relative to the corresponding lower surface at the first or second distal portion of the elongate frame with the associated removable corner brush on the elongate frame, such that the lower surface at the middle portion extends at a first angle relative to the stem assembly, the lower surface at the first and second distal portions extends at a second angle relative to the stem assembly, and the upwardly curved surface extends a third angle relative to the stem assembly, wherein the first, second, and third angles are different angles relative to the stem assembly; and at least one magnetic component disposed on an exterior surface of the removable corner brushes such that the magnetic component is positioned adjacent a front of the brush head, said magnetic component positioned to pick up magnetic debris in water in a manner such that the magnetic debris does not adhere to the cleaning surface.

2. The modularly designed cleaning tool of claim 1 further comprising a reinforcement member, wherein the reinforcement member comprises a interior annular shoulder.

3. The modularly designed cleaning tool of claim 1, wherein the stem assembly comprises a buttoned clip positioned inside the stem assembly, wherein the clip comprises two diverging legs that extend along an axis perpendicular to the axis defined by the elongate frame of the brush head.

4. The modularly designed cleaning tool of claim 1, wherein the stem assembly comprises two separatable halves.

5. The modularly designed cleaning tool of claim 2, wherein the reinforcement member is disposed in place by the attachment of a tubular handle to the stem assembly.

6. The modularly designed cleaning tool of claim 2, wherein the reinforcement member extends from the brush head a shorter distance than the stem assembly.

7. The modularly designed cleaning tool of claim 1, wherein the stem assembly and brush head are integrally formed.

8. The modularly designed cleaning tool of claim 1, wherein the removable corner brushes receive the elongate frame into a cavity in the removable corner brushes.

9. The modularly designed cleaning tool of claim 1, wherein the removable corner brushes each have a generally flat bottom edge extending proximally towards the elongate frame and an upwardly curved edge extending distally away from the elongate frame, the upwardly curved edge located distal to the flat bottom edge, and the bristles on each of the removable corner brushes extending from both the flat bottom edge and the upwardly curved edge along a continuous surface from the flat bottom edge and the upwardly curved edge.

10. A modularly designed cleaning tool, comprising:

a brush head comprising an elongate frame and bristles extending therefrom, said elongate frame having an upper surface, a lower surface, and two sidewalls extending therebetween; and removable corner brushes each having a proximal end and a distal end, wherein each of the removable corner brushes comprises a U shaped track configured to slidably engage with a respective end of the elongate frame in a manner such that the respective removable corner brush fits over and covers the ends of the elongate frame such that the respective removable corner brush is not coplanar with the elongate frame, wherein the removable corner brushes are detachably connected to the elongate frame, wherein the removable corner brushes each comprises bristles extending generally away from a bristle surface of the removable corner brushes in a manner such that bristles adjacent the distal end of the removable corner brushes extend outwardly at an angle different from the angle which bristles disposed at the distal end of the elongate frame extend, and wherein the bristle surface of each removable corner brush is angled upwardly relative to the lower surface at the respective end of the elongate frame with the respective end of the elongate frame in the U shaped track such that the different angle of the bristles adjacent the distal end of the removable corner brushes corresponds to the bristle surface being angled upwardly relative to the lower surface of the brush head, wherein the bristles disposed at the respective end of the elongate frame extend from the respective end at the proximal end of the respective removable corner brush with the respective end of the elongate frame in the U shaped track, and wherein the bristles at the distal end extending from the bristle surface of the respective removable corner brush are at a different angle relative to the bristles disposed at the respective end of the elongate frame extending at the proximal end of the respective removable corner brush to provide bristles at two different angles along an extent from the proximal end to the distal end of the respective removable corner brush.

11. The modularly designed cleaning tool of claim 10, wherein each of the removable corner brushes comprises a location indicator along the U shaped track, said location indicator configured to engage with a corresponding location indicator on the elongate frame to secure the removable corner brush to the elongate frame at a desired location.

12. The modularly designed cleaning tool of claim 11, wherein the location indicator comprises a notch.

13. The modularly designed cleaning tool of claim 10, wherein an upper surface of the removable corner brush protrudes upwardly from the upper surface of the elongate frame so as to form a step.

14. The modularly designed cleaning tool of claim 10, wherein, with the respective end of the elongate frame in the U shaped track, a proximal portion of an upper surface of the respective removable corner brush at the proximal end extends substantially at the same angle as the upper surface of the respective end of the elongate frame, and wherein, with the respective end of the elongate frame in the U shaped track, a distal portion of the upper surface of the respective removable corner brush at the distal end extends at a different angle upwardly from the upper surface of the respective end of the elongate frame to accommodate the different angle of the bristle surface.

15. The modularly designed cleaning tool of claim 10, wherein the bristle surface extends from an end of the U shaped track and outside the U shaped track.

16. A cleaning tool with a removable corner brush, comprising:

a brush head comprising an elongate frame and bristles extending therefrom, said elongate frame having an upper surface, a lower surface, and two sidewalls extending therebetween, wherein the elongate frame comprises:

a middle portion;

a first distal portion connected to the middle portion; and a second distal portion connected to the middle portion opposite the first distal portion, wherein the first distal portion and the second distal portion extend from the middle portion at an angle, respectively, such that the first and second distal portions are angled relative to the middle portion, wherein the distal ends of the bristles together form a cleaning surface along the middle portion and the first and second distal portions of the elongate frame;

a stem assembly extending outwardly from the brush head, wherein the bristles extend from the lower surface at the middle portion such that the cleaning surface extends substantially perpendicular to the stem assembly along the middle portion, and wherein the bristles extend from the lower surface at the first and second distal portions such that the cleaning surface along the first and second distal portions is angled relative to the cleaning surface along the middle portion; and a removable corner brush having a proximal end and a distal end, the removable corner brush comprising a bristle surface near the distal end, the removable corner brush configured to receive the first or second distal portion of the elongate frame so that the removable corner brushes are detachably connected to the elongate frame, wherein the removable corner brush comprise bristles extending from the bristle surface of the removable corner brush at an angle different from the angle which bristles disposed at the first and second distal portions of the elongate frame extend to form an additional cleaning surface along the removable corner brush, with the removable corner brush on the elongate frame, wherein the bristle surface is angled relative to the corresponding lower surface at the first or second distal portion of the elongate frame with the removable corner brush on the elongate frame, such that the lower surface at the middle portion extends at a first angle relative to the stem assembly, the lower surface at the first and second distal portions extends at a second angle relative to the stem assembly, and the bristle surface of the removable corner brush extends a third angle relative to the stem assembly, wherein the first, second, and third angles are different angles relative to the stem assembly.

17. The cleaning tool of claim 16, wherein the bristle surface is curved such that the angle of the bristles and corresponding angle of the additional cleaning surface changes along the bristle surface.

18. The cleaning tool of claim 17, wherein the bristle surface continually curves toward the distal end of the removable corner brush such that a density of bristles extending from the bristle surface is less dense at the additional cleaning surface relative to the density of bristles at the cleaning surface of the elongate frame.

19. The cleaning tool of claim 16, wherein, with the removable corner brush on the elongate frame, a proximal portion of an upper surface of the removable corner brush at the proximal end extends substantially at the same angle as the upper surface of the first and second distal portions of the elongate frame, and wherein, with the removable corner brush on the elongate frame, a distal portion of the upper surface of the removable corner brush at the distal end extends upwardly at a different angle from the upper surface of the first and second distal portions of the elongate frame to accommodate the different angle of the bristle surface.

20. The cleaning tool of claim 16, wherein the removable corner brush is configured to rigidly connect to the elongate frame.

* * * * *